US006578304B1

(12) United States Patent
Lytle

(10) Patent No.: US 6,578,304 B1
(45) Date of Patent: Jun. 17, 2003

(54) MAGNETIC FRAME

(76) Inventor: David Bruce Lytle, 920 N. Pike Rd., Cabot, PA (US) 16023

( * ) Notice: Subject to any disclaimer, the term of this patent is extended or adjusted under 35 U.S.C. 154(b) by 65 days.

(21) Appl. No.: 09/828,669

(22) Filed: Apr. 9, 2001

(51) Int. Cl.[7] ..... A47G 1/06
(52) U.S. Cl. ..... 40/711; 40/124.04; 40/124.06
(58) Field of Search ..... 40/124.04, 124.06, 40/600, 711, 768, 771, 774, 776; 229/71

(56) References Cited

U.S. PATENT DOCUMENTS

| | | | | | |
|---|---|---|---|---|---|
| 3,187,449 | A | | 6/1965 | Longo | |
| 3,237,327 | A | | 3/1966 | Griggs | |
| 3,826,026 | A | | 7/1974 | Bevan | |
| 4,236,331 | A | | 12/1980 | Mattson | |
| 4,244,511 | A | * | 1/1981 | Coleman | 229/92.1 |
| 4,450,638 | A | * | 5/1984 | Bader | 40/774 |
| 4,771,557 | A | | 9/1988 | Bowman | |
| 4,785,562 | A | | 11/1988 | Good | |
| 5,036,310 | A | * | 7/1991 | Russell | 340/569 |
| 5,274,937 | A | * | 1/1994 | Birnbaum | 40/600 |
| 5,303,489 | A | * | 4/1994 | Blegen | 40/711 |
| 5,309,659 | A | | 5/1994 | Eastman | |
| 5,579,908 | A | * | 12/1996 | Johnson | 206/308.3 |
| 5,699,956 | A | * | 12/1997 | Brennan | 229/92.8 |
| 5,788,144 | A | * | 8/1998 | Sorge et al. | 229/92.8 |
| 5,833,129 | A | * | 11/1998 | Smith | 299/92.8 |
| 5,904,373 | A | * | 5/1999 | Krapf | 281/29 |
| 5,924,624 | A | * | 7/1999 | Martin | 229/71 |
| 6,052,933 | A | | 4/2000 | Lytle | |
| 6,189,774 | B1 | * | 2/2001 | Pearson | 229/92.8 |
| 6,237,837 | B1 | * | 5/2001 | Martin | 229/71 |

OTHER PUBLICATIONS

Patent Application entitled "Mailable Magnetic Frame" by David Lytle, Filed Concurrently Herewith.

* cited by examiner

*Primary Examiner*—S. Joseph Morano
*Assistant Examiner*—Andrew Wright
(74) *Attorney, Agent, or Firm*—Aileen Champion Addessi

(57) ABSTRACT

A magnetic frame for displaying an object, such as a photograph or other item, on a magnetically attractive surface, such as a refrigerator, cabinet, or the like, includes an envelope for enclosing the object therein. The magnetic frame further includes a flat magnetic sheet having at least one magnetized surface for magnetic attraction through the envelope to the magnetically attractive surface. The magnetic sheet is positioned within the envelope adjacent to the object for attaching the magnetic frame to the magnetically attractive surface for displaying the object through a transparent portion of the envelope.

16 Claims, 3 Drawing Sheets

MAGNETIC FRAME

BACKGROUND OF THE INVENTION

The invention relates to holders for displaying an object and, more particularly, to a magnetic frame which can be magnetically attached to a surface.

Objects, such as photographs, children's artwork, children's class work, honors, awards, or other flat objects, are mounted on refrigerators, filing cabinets, shelves, kitchen appliances, or other magnetically attractive surfaces. The object may be mounted in homes, offices, in public areas, or the like for displaying and enabling others to readily view the object.

To protect the photograph or other flat object and enhance its visual appeal, a variety of frames and holders are available. One such frame is disclosed in U.S. Pat. No. 6,052,933 to Lytle. The picture framing system has a magnet attached to the outside of a pocket for retaining a photograph therein. The magnet may be attached directly to the refrigerator or other magnetized surface for displaying the photograph.

U.S. Pat. No. 3,826,026 to Bevan discloses a display device including a magnetic mounting sheet and a transparent sheet heat sealed to each other. An indicia sheet may be placed between the mounting sheet, which may be detachably secured to a metallic surface, and the transparent sheet for displaying the indicia sheet. However, the magnet is directly attached to the metallic surface.

U.S. Pat. No. 3,237,327 to Griggs discloses a certificate holder including a transparent pocket with a flap. However, the magnets are attached to the outside of the envelope and may become loose and fall off of the envelope.

U.S. Pat. No. 5,309,659 to Eastman discloses a frame having a stiff transparent sheet and a magnetic sheet to be attached directly to a metallic surface and a space therebetween for insertion of an object to be displayed. However, the photograph and magnet sheet may inadvertently slip out of the frame.

U.S. Pat. No. 4,236,331 to Mattson discloses a magnetic badge assembly including a magnetic material enclosed by a plastic film jacket. However, the display panel in also enclosed within the plastic film jacket.

U.S. Pat. No. 3,187,449 to Longo et al. discloses a magnetic frame. However, the frame is bulky and requires assembly of numerous components each time the photograph is changed.

U.S. Pat. No. 4,771,557 to Bowman discloses a transparent pocket for adhesive attachment in an album or the like, but does not disclose a magnet for attaching the pocket to a magnetically attractive surface.

U.S. Pat. No. 4,785,562 to Good discloses a magnetic holder having an opening for viewing the display and several magnets for securing the holder to a magnetically attractive surface. However, the holder does not have a sleeve or pocket for containing the display item.

Therefore, what is needed is an apparatus for holding an object to be displayed which utilizes a magnetic sheet housed within the frame.

SUMMARY OF THE INVENTION

A magnetic frame for displaying a flat object on a magnetically attractive surface includes an envelope having a front flexible transparent sheet and a backing attached to each other for forming a pocket therebetween. The envelope has at least one open end for enabling the object to be removably inserted through one of the open ends and into the envelope for retaining the object between the front sheet and the backing. A flat magnetic sheet is removably disposed within the envelope by inserting the flat magnetic sheet through the open end of the envelope and positioned between the object and the backing of the envelope. The flat magnetic sheet has a front surface and a magnetized rear surface which is positioned facing the backing of the envelope for removable securement of the envelope to the magnetically attractive surface.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings, wherein:

DESCRIPTION OF THE PREFERRED EMBODIMENT

Figure 1:
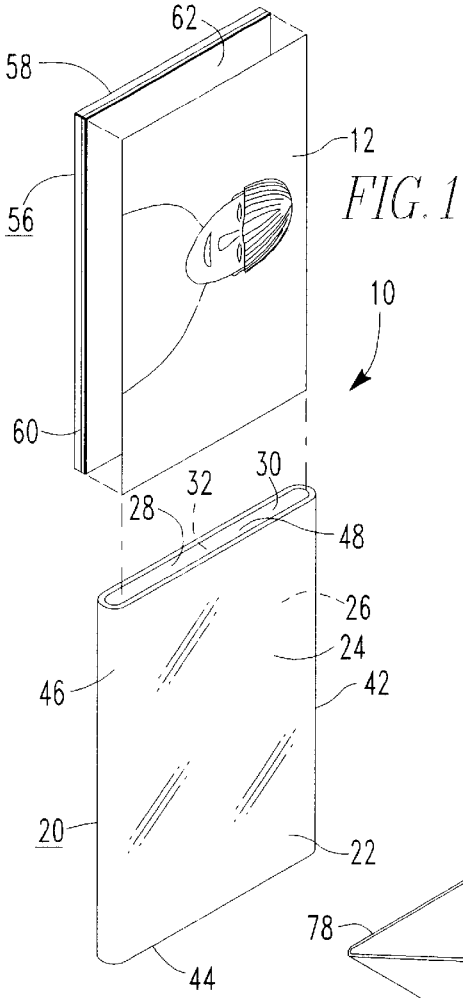
FIG. 1 is an exploded perspective view of a magnetic frame.
Figure 2:
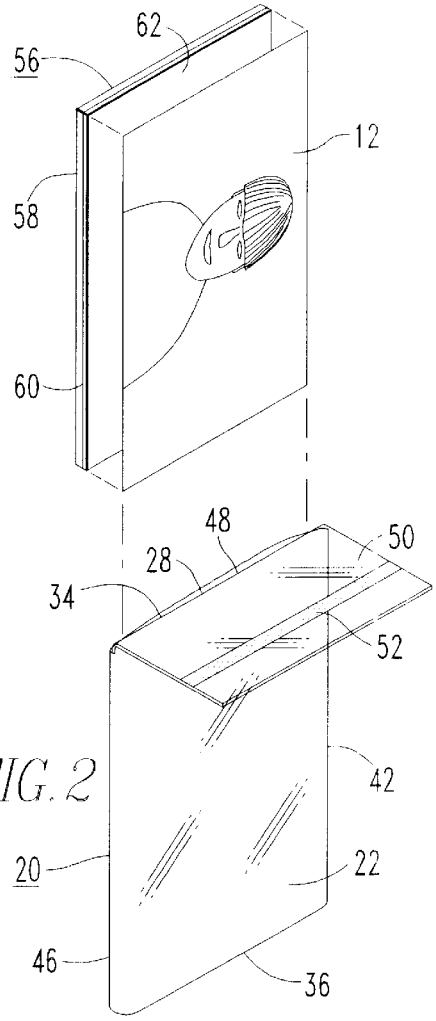
FIG. 2 is an exploded perspective view of an alternative embodiment of the magnetic frame illustrated in FIG. 1 having a flap.

Referring to FIGS. 1 and 2, a magnetic frame 10 may be used to mount an object, such as a photograph 12 or other flat object, onto a ferrous metal surface for displaying the object. The magnetic frame 10 may be magnetically attached to any magnetically attractive surface, such as a refrigerator, cabinet, or other surface. The magnetic frame 10 includes an envelope 20 formed by a front flexible transparent sheet 22 which has a flat, front surface 24 and an opposite flat, rear surface 26. Disposed parallel to and behind the front sheet 22 is a protective backing 28, such as a back flexible transparent sheet, a back flexible opaque sheet, or other type of backing. The protective backing 28 includes a facing surface 30 and an opposite backing surface 32.

The front sheet 22 and the backing 24 may be integrally formed together or may be separate sheets attached together. For an embodiment including separate sheets attached together, the front sheet 22 and the backing 24 should be approximately the same size, and may be square or rectangular-shaped. The front sheet 22 and the backing 24 are positioned parallel and adjacent to one another. For an embodiment including the front sheet 22 and the backing 24 integrally formed together, the envelope 20 is formed by folding a single piece of material along an upper fold 34 and a lower fold 36, thereby defining the envelope 20 having the front sheet 22 and the opposed backing 24. Alternatively, the edge 36 may be a sealed edge. For either embodiment, the desired number of edges are attached together, such as by heat sealing, adhesively, crimping, folding, or the like.

As illustrated in FIG. 1, the envelope 20 has a first sealed edge 42, a second sealed edge 44, a third sealed edge 46, and one open end 48. The open end 48 of the envelope 20 permits insertion and removal of a photograph or other object to be displayed between the front sheet 22 and the backing 24. As an alternative, as illustrated in FIG. 2, the envelope 20 may further include a flap 50, integrally formed therewith or a separate piece of material, for completely enclosing the object 12 within the envelope 20. The flap 50 overlaps the backing 24 and has a self-adhesive strip 52 or other suitable means of closure for removably securing the flap 50 to the backing 24 for retaining the object 12 within the magnetic frame 10.

The front sheet 22 and backing 24 may be manufactured from a flexible clear plastic material or the like. The envelope 20 should be sized to allow easy insertion and removal of the object 12 and to hold the object 12 therein by surface friction. The magnetic frame 10 can be manufactured in various sizes to accommodate different sized objects, such as wallet sized photographs, 4"×6" photographs, 8 ½"×11" sheets of paper, or other desired size. Any of the sides of the envelope 20, such as the sealed edges 42, 44, 46 or open end 48 may be sealed, folded, or open for providing a variety of types of envelopes.

The magnetic frame 10 further includes a magnetic sheet 56 which has a magnetic surface 58 and an opposed front surface 60. As one example, the magnetic sheet 56 may be a thin sheet of rubber with fine ferrous metal powder intermixed and embedded within the magnetic sheet 56. The fine ferrous metal powder may be magnetized by passing the magnetic sheet 56 in close proximity to an electrical field. The magnetic sheet 56 is assembled with the magnetic surface 58 of the magnetic sheet 56 facing the backing 24 and the opposed front surface 60 facing the front transparent sheet 22. The magnetic sheet 56 has, preferably, substantially the same size and shape as the front sheet 22 and the sheet 24.

Alternatively, the front surface 60 of the magnetic sheet 56 may also be magnetized for enabling the magnetic sheet 56 to be inserted in either direction into the envelope for attraction to the magnetically attractive surface.

The magnetic sheet 56 may further include a backing sheet 62, such as a white piece of vinyl or paper. The backing sheet 62 is attached to the front surface 60 of the magnetic sheet 56 and faces the front transparent sheet 22. The backing sheet 62 provides a background for the object 12 that is being displayed. Alternatively, the backing sheet 62 may be any color and have any design for increasing the visual appeal of the magnetic frame 10.

To assemble the magnetic frame 10, the magnetic sheet 56 is inserted into the envelope 20 between the front transparent sheet 22 and the backing 24. The object 12 is inserted between the magnetic sheet 56 and the front transparent sheet 22 having the side of the object 12 to be displayed facing toward the front transparent sheet 22 for enabling a person to view the object 12 through the front transparent sheet 22. The magnetic frame 10 can be attached to a steel or magnetically attractive surface (not shown) by placing the backing 24 adjacent to the magnetically attractive surface. The magnetic attraction of the magnetic sheet 56 through the backing 24 will secure the magnetic frame 10 to the magnetically attractive surface.

For the various embodiments of this invention, the same reference characters will be used to designate like parts. In addition, like functions and like interactions of the parts among the various embodiments of this invention will not be repeated for each embodiment.

Figure 3:
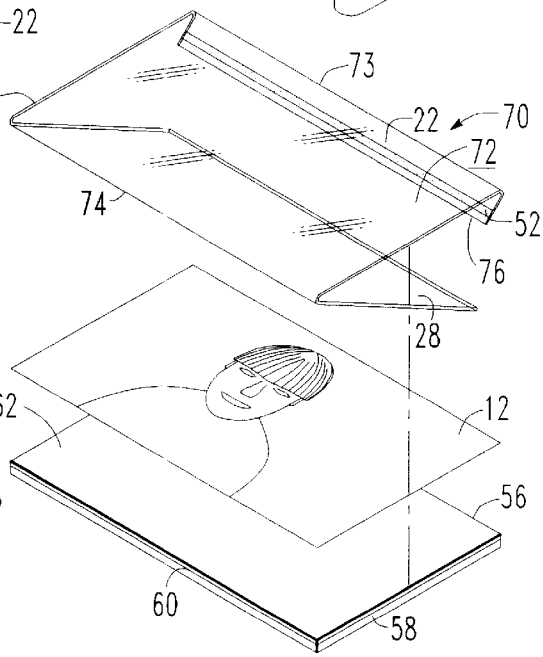
FIG. 3 is an exploded perspective view of another alternative embodiment of the magnetic frame having the envelope formed as a sleeve.

Referring to FIG. 3 and using the same reference characters to define like parts, an alternative embodiment of the magnetic frame 10 as illustrated in FIGS. 1–2 may be a magnetic frame 70 having like parts as the magnetic frame 10. The envelope of the magnetic frame 70 is a sleeve 72 having two closed edges, such as edges 73 and 74, and two open edges, such as edges 76 and 78. The two closed edges 73 and 74 may either be two pieces of material attached together, or alternatively, may include a single piece of material folded and attached to form the sleeve 72. The magnet and object are slid into the sleeve through either of the open ends 76 or 78 and are retained there, such as by surface friction and/or gravity.

Figure 4:
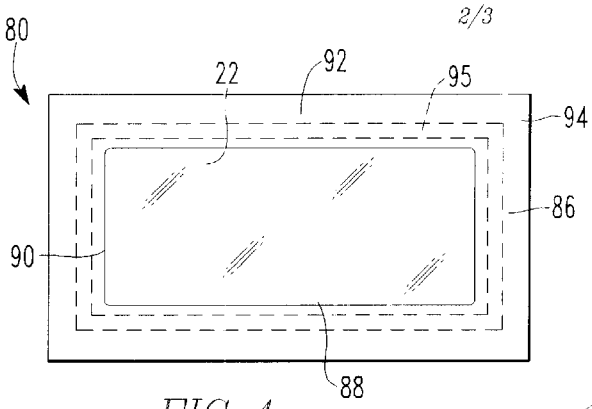
FIG. 4 is a front elevational view of yet another alternative embodiment of the magnetic frame illustrating an envelope having a plurality of flaps.
Figure 5:
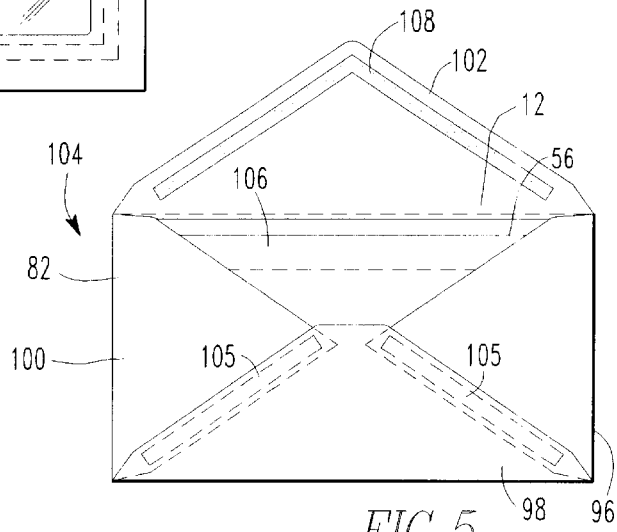
FIG. 5 is a rear elevational view of the magnetic frame of FIG. 4.

Referring to FIGS. 4 and 5 and using the same reference characters to define like parts, an alternative embodiment of the magnetic frame 10 as illustrated in FIG. 1 may be a magnetic frame 80 having like parts as the magnetic frame 10 and having a backing 82 with a plurality of flaps. The backing 82 may be constructed of an opaque piece of paper, or alternatively, may be transparent plastic, vinyl, milar, or other suitable material. The backing 82 may be white, colored, have a pattern or design, or combinations thereof. The front transparent sheet 22 includes side edges 86, 88, 90, and 92. The backing 82 includes a border portion 94 which overlaps a portion of each of the side edges 86, 88, 90 and 92 forming a border around the object 12 for visual appeal. The front transparent sheet 22 that is exposed within the border portion 94 provides a window for viewing the object 12 therethrough. The front transparent sheet 22 is attached to the border portion 94 of the backing 82, such as by glue 95 or other suitable means. The border 94 can be printed with suitable designs to form a decorative matte around the photograph or object.

The backing 82 further includes a first flap 96, a second flap 98, a third flap 100, and may alternatively, include a fourth flap 102, which are attached to the border portion 92, such as integrally formed with the border portion 94, attached thereto, or the like. The flaps 96, 98 and 100 are folded about the side edges 86, 88, 90 and 92 of the front transparent sheet 22. After folded, the flaps 96, 98 and 100 are overlapped with one another and attached thereto for forming an envelope 104 having an open end 106 for insertion of the object 12. The flaps 96, 98 and 100 may be attached by glue 105 or the like. The fourth flap 102 may have a self-adhesive strip 108 or the like for removable attachment of the fourth flap 102 to the other flaps 96, 98 and 100 for closing the open end 106 and enclosing the object 12 and the magnetic sheet 56 within the envelope 104.

Figure 6:
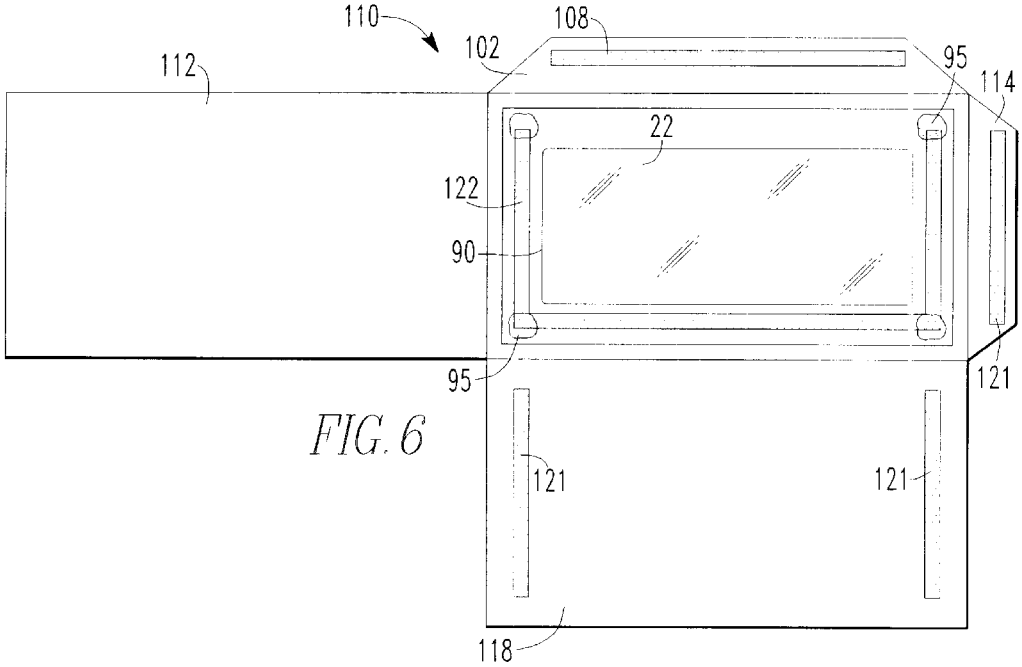
FIG. 6 is a view of yet another alternative embodiment of the magnetic frame illustrating an envelope having two pockets.
Figure 7:
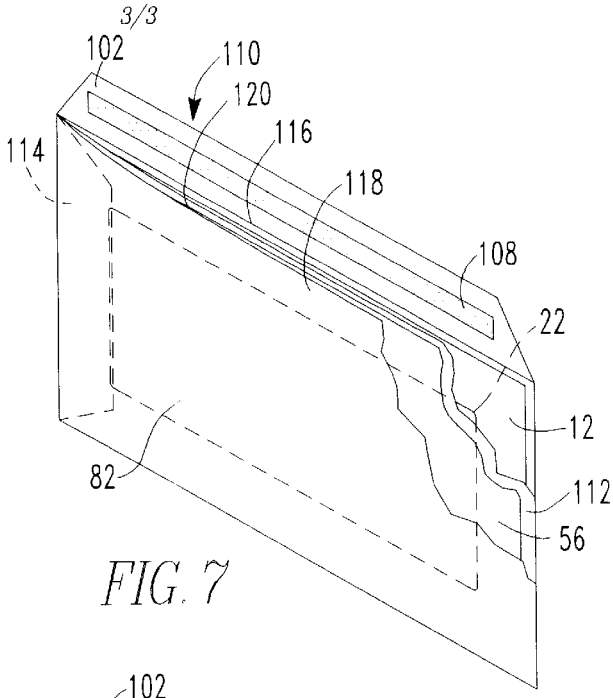
FIG. 7 is a partially broken rear elevational view of the magnetic frame of FIG. 6.

Referring to FIG. 6 and 7 and using the same reference characters to define like parts, an alternative embodiment of the magnetic frame 80 as illustrated in FIGS. 4 and 5 may be a magnetic frame 110 having like parts as the magnetic frame 80 and having two of the flaps, such as flaps 112 and 114, attached together and acting as an inner dividing member for providing a space or first pocket 116 between the flaps 112 and 114 and the front transparent sheet 22. An additional flap, such as flap 118, is attached to the first and second flaps 112 and 114 along three edges for providing a second pocket 120. As one example, the flap 118 is preferably folded from the bottom of the frame 110 toward the top of the frame 110 for providing a bottom sealed edge. The side edges of the flap 118 may be adhesively attached to the flaps 112 and 114 or the like. The flaps 112, 114 and 118 may be attached together adhesively, such as by glue 121, or by any other suitable means. The first and second pockets 116 and 120 are positioned parallel and adjacent to one another for enabling the object 12 to be contained within the first pocket 116 and the magnetic sheet 56 to be positioned behind the object 12 in the second pocket 120. The magnetic attraction of the magnetic sheet 56 through the flap 118 will secure the magnetic frame 110 to the magnetically attractive surface.

The magnetic frame 110 may additionally have a support 122, such as a strip of glue, an additional strip of material, or the like for supporting the object 12 within the pocket 116 and enabling the object 12 to be aligned within the border portion 94 for viewing the photograph 12 through the transparent sheet 22. As one example, if the support 122 is a strip of glue, the glue may be applied to the flap 112 in a U-shaped pattern, to the border portion 94, or to the transparent sheet 22 The flap 112 is then folded and secured to the strip of glue. After the glue is dry, the object 12 may be inserted into the pocket 116 and held in position by the U-shaped support 122. Alternative embodiments may include the flap 118 folded first for forming the pocket to hold the object 12, the flap 112 folded second and secured with the appropriate glue, and the flap 114 folded third and secured with glue for forming the pocket to hold the magnet 56.

Figure 8:
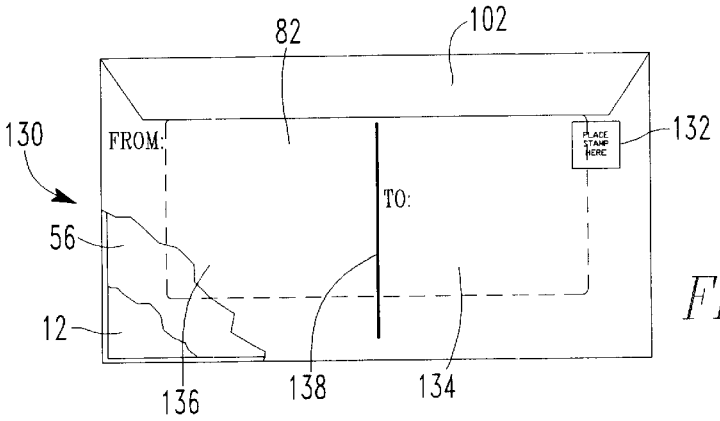
FIG. 8 is a partially broken rear elevational view of yet another alternative embodiment of the magnetic frame having a postcard design on its rear surface for enabling the magnetic frame to be mailed and a message to be added.

Referring to FIG. 8 and using the same reference characters to define like parts, an alternative embodiment of the magnetic frame 80 or 110 as illustrated in FIGS. 4–7 may be the magnetic frames 80 and 110 having a postcard design printed on the backing 82 of the magnetic frames 80 and 110. The postcard design 130 may include a space 132 for placement of a postage stamp and may be pre-printed with instructions, such as "place postage here" or the like. The design 130 may also include a space 134 for placement of an address for mailing the magnetic frame with the object 12 to someone. The space 134 may include a message, such as the word "To:" or the like. An additional space 136, which may be separated from space 134 by a line 138, may be provided for placement of the sender's address or for writing a message to the receiver of the postcard magnetic frame.

The mailable embodiments of the magnetic frame can also be inserted into a clear plastic envelope, such as the envelope 20 for added protection.

Figure 9:
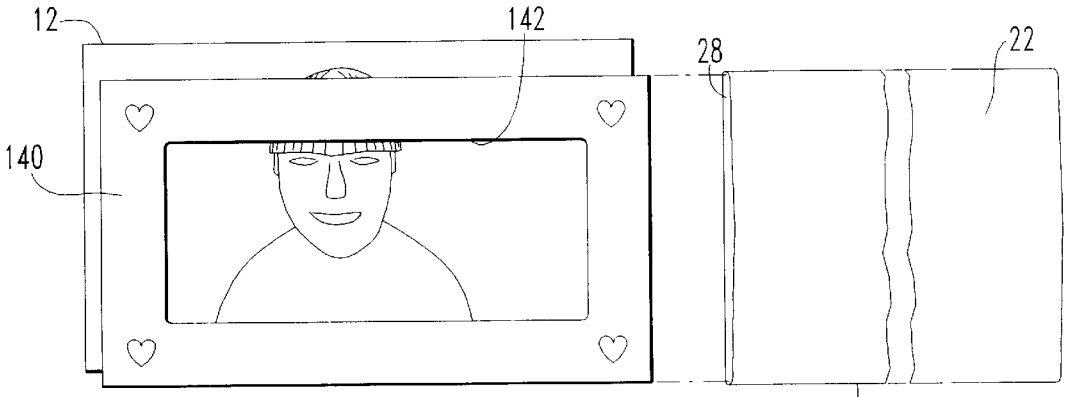
FIG. 9 is a view of yet another alternative embodiment of the magnetic frame having a magnetic sheet formed as a matte surrounding the object and displaying the object therethrough.

Referring to FIG. 9 and using the same reference characters to define like parts, an alternative embodiment of the magnetic sheet 56 as illustrated in FIGS. 1–8 may be a magnetic sheet 140 having like parts as the magnetic sheet 56 and having an opening 142 therethrough. The opening 142 is cut through a center portion of the magnetic sheet 140 forming the magnetic sheet 56 into a matte. The object 12 may be positioned under or behind the magnetic sheet 140 enabling the object 12 to be displayed through the opening 142 of the magnetic sheet 140. The magnetic sheet 140 provides a border around the photograph of object 12, which may be decorated with various designs, colors, symbols, words or the like.

The magnetic sheet 140 and the object 12 are insertable into an envelope, such as the envelope 20. The magnetic surface 58 of the magnetic sheet 140 is positioned facing the backing 24 of the envelope 20 for enabling the magnetic surface 58 to face a magnetically attractive surface, such as a refrigerator. The magnetic attraction of the magnetic matte 140 through the object 12 and through the envelope 20 will hold the magnetic frame to the magnetically attractive surface.

Referring to FIGS. 1–9, the various types of envelopes that have been shown and described are illustrative of only a few examples of the types of envelopes that can be used for the magnetic frame. Numerous other variations of the envelope may be used, such as envelopes having different sized and shaped flaps, different sized and shaped transparent windows, various open and closed edges, or any other suitable shape and design.

An advantage of the magnetic frame is that the object 12 and magnetic sheet 56 are completely contained within the magnetic frame for protecting the photograph or other object from damage, such as from contact with a person's fingers. The transparent feature of the envelope 20 permits viewing of the object 12 while still protecting the object 12 within the magnetic frame.

The enclosed feature of the magnetic frame enables the object 12 and the magnetic sheet 56 to be stored within the magnetic frame without the object 10 or magnetic sheet 56 falling out of the frame during display of the object 12 on a steel surface. All of the components of the frame are packaged within a holder that allows viewing of the object and attachment of the object to a magnetically attractive surface.

Another advantage of the magnetic frame is that the attraction of the magnetic sheet 56 through the envelope 20 enables attachment of the magnetic frame to a magnetically attractive surface.

Yet another advantage of the magnetic frame is that it may be mailed to someone else. Since the object and magnetic sheet are contained within an enclosed envelope, the back of the envelope can be addressed and the envelope mailed through the postal service.

An advantage of the magnetic frame having a magnetic sheet formed as a matte is that, in addition to the aesthetic appeal of the border surrounding the photograph or object, the overall weight of the magnetic frame is reduced.

Thus there has been shown and described a novel magnetic frame which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A magnetic frame for displaying a flat object on a magnetically attractive surface, comprising:

an envelope having a front flexible transparent sheet with side edges and a backing attached to each other, the backing having a first flap, a second flap, and a third flap each attached to the side edges of the front sheet and bendable rearwardly toward each other, and each flap overlapping at least a portion of another one of the other flaps and attached thereto for forming at least one pocket of the envelope, the backing has a fourth flap attached to one of the side edges and foldable rearwardly toward the overlapping attached flaps and releasably attached thereto for enabling the flap to be opened to exchange one object for another and for enclosing the object within the envelope, the envelope having at least one open end for enabling the object to be removably inserted through one of the open ends and into the envelope for retaining the object within the envelope;

a first pocket formed by attaching the first flap to the second flap, the first pocket positioned between the front transparent sheet and the first and second flaps for containing the object within the first pocket of the envelope;

a second pocket formed by attaching the third flap to the first and second flaps, the second pocket positioned between the first and second flaps and the third flap, the first pocket positioned parallel and adjacent to the second pocket; and a flat magnetic sheet removably disposed within the envelope by inserting the flat magnetic sheet through the open end of the envelope into the second pocket, the flat magnetic sheet having a front surface and a magnetized rear surface which is positioned facing the backing of the envelope for removable securement of the envelope to the magnetically attractive surface.

2. The magnetic frame according to claim 1, wherein the envelope is formed from a single piece of material folded to define the front transparent sheet for permitting viewing of the object and the opposed backing, the envelope being open along at least one edge thereof to permit insertion and enveloping of the object between the opposed front sheet and the backing.

3. The magnetic frame according to claim 1, wherein the front surface of the magnetic sheet is magnetized for enabling either the front surface or the rear surface of the magnetic sheet to be attached to the magnetically attractive surface.

4. The magnetic frame according to claim 1, wherein the backing has a border portion attached to and overlapping a portion of each of the side edges of the front flexible transparent sheet for allowing a portion of the front flexible transparent sheet to be exposed through the border portion for providing a window for viewing the object and for forming a border about the window to enhance the aesthetic appeal of the magnetic frame.

5. The magnetic frame according to claim 1, further comprising a U-shaped support attached to the envelope and positioned within the first pocket of the envelope for supporting and aligning the object within the envelope.

6. The magnetic frame according to claim 1, wherein the backing is printed with a postcard design for enabling the magnetic frame to be sent through the mail and to be attached to the magnetically attractive surface for displaying the object contained therein.

7. The magnetic frame according to claim 6, wherein the postcard design includes a first space for placement of postage, a second space for placement of an address, and a third space for writing a message to a recipient of the magnetic frame.

8. A magnetic frame for displaying an object on a magnetically attractive surface, comprising:

an envelope having a front flexible transparent sheet and a backing, the envelope having at least one open end for enabling the object to be removably inserted therein;

a magnetic sheet removably disposed within the envelope by inserting the magnetic sheet through the at least one open end of the envelope and positioned between the object and the backing of the envelope, the magnetic sheet having at least one magnetized surface for removable attachment of the envelope, with the object and magnetic sheet contained therein, to the magnetically attractive surface, and a backing sheet positioned within the envelope between the magnetic sheet and the object and positioned facing the object for providing a visually appealing background behind the object.

9. The magnetic frame according to claim 8, wherein the envelope has a back surface which is printed with a postcard design for enabling the magnetic frame to be sent through the mail and to be attached to the magnetically attractive surface.

10. The magnetic frame according to claim 8, wherein the envelope includes:

the front transparent sheet having side edges; and the backing having a border portion attached to and overlapping a portion of each of the side edges of the front transparent sheet for allowing a portion of the front transparent sheet to be exposed through the border portion for providing a window for viewing the object and for forming a border about the window to enhance the aesthetic appeal of the magnetic frame, the backing has a plurality of flaps each attached to the border portion and bendable rearwardly toward each other, and each flap overlapping at least a portion of another one of the other flaps and attached thereto for forming a pocket within the envelope containing the magnetic sheet and the object.

11. The magnetic frame according to claim 8, wherein the envelope is formed from a single sheet of material folded to define the front transparent sheet for permitting viewing of the object, the front sheet of the single piece of material further folded to define a flap overlapping a portion of backing and releasably attached thereto for enclosing the object within the envelope and for enabling the flap to be opened to exchange one object for another.

12. The magnetic frame according to claim 8, wherein the front sheet is further folded to define a flap overlapping a portion of the backing and sealed thereto forming a sleeve having two open side edges for insertion of the object.

13. The magnetic frame according to claim 8, wherein the front transparent sheet and the backing are opposed flat sheets attached to each other along at least two edges so that at least one opening is formed for enabling both the magnetic sheet and the object to be removably inserted through the opening and into the envelope.

14. The magnetic frame according to claim 8, wherein the magnetic sheet has an opening therethrough for providing a border around the object and for displaying the object through the opening of the magnetic sheet.

15. A magnetic frame for displaying an object on a magnetically attractive surface, comprising:

an envelope having at least one open end for enabling the object to be removably inserted therein and having a back surface which is printed with a postcard design for enabling the magnetic frame to be sent through the mail and to be attached to the magnetically attractive surface;

a piece of material positioned to form a U-shaped support attached to the envelope and positioned within the envelope for supporting and aligning the object within the envelope; and a magnetic sheet removably disposed within the envelope by inserting the magnetic sheet through the at least one open end of the envelope and positioned adjacent to the object, the magnetic sheet having at least one magnetized surface, the magnetic frame removably attachable to the magnetically attractive surface by positioning the envelope with the magnetic sheet and object contained therein against the magnetically attractive surface having the magnetized surface of the magnetic sheet facing the magnetically attractive surface.

16. The magnetic frame according to claim 15, wherein the magnetic sheet has an opening therethrough for providing a border around the object and for displaying the object through the opening of the magnetic sheet.

* * * * *